United States Patent [19]

Brandt et al.

[11] 4,045,881

[45] Sept. 6, 1977

[54] SYSTEM FOR VENTING THE HEATING PIPES OF A TUBULAR ROTARY DRYER

[75] Inventors: Bernd Brandt, Wesseling-Berzdorf; Peter Jansen; Heinz Liesenfeld, both of Wesseling, all of Germany

[73] Assignee: Deutsche Gold- und Silber-Scheideanstalt vormals Roessler, Frankfurt am Main, Germany

[21] Appl. No.: 599,301

[22] Filed: July 25, 1975

[30] Foreign Application Priority Data

Aug. 27, 1974 Germany ..... 2440897

[51] Int. Cl.[2] ..... F26B 11/04

[52] U.S. Cl. ..... 34/138; 34/134; 165/81; 165/88

[58] Field of Search ..... 34/138, 134, 119, 124, 34/125; 165/81, 88

[56] References Cited

U.S. PATENT DOCUMENTS

| | | | |
|---|---|---|---|
| 623,230 | 4/1899 | Argall | 165/88 |
| 642,948 | 2/1900 | Bachrich | 165/88 |
| 1,584,764 | 5/1926 | Gertz | 34/134 X |
| 1,671,798 | 5/1928 | Vermilye | 165/88 |
| 2,238,273 | 4/1941 | Lissauer | 165/88 |
| 2,354,567 | 7/1944 | Ady | 34/134 |
| 3,274,698 | 9/1966 | Ashby | 34/134 X |

FOREIGN PATENT DOCUMENTS

| | | | |
|---|---|---|---|
| 1,044,642 | 11/1953 | France | 165/81 |
| 30,987 | 9/1970 | Japan | 432/112 |
| 631,574 | 11/1949 | United Kingdom | 165/81 |

*Primary Examiner*—William F. O'Dea
*Assistant Examiner*—Harold Joyce
*Attorney, Agent, or Firm*—Beveridge, DeGrandi, Kline and Lunsford

[57] ABSTRACT

Air is vented from steam-charged heating pipes of a tubular rotary dryer via connector pipes and a collecting pipe which is disposed circumferentially around the dryer drum. Holding blocks provided with inwardly-biased rollers support the collecting pipe for longitudinal movement on the exterior wall of the dryer drum.

12 Claims, 3 Drawing Figures

SYSTEM FOR VENTING THE HEATING PIPES OF A TUBULAR ROTARY DRYER

This invention relates to a system for venting the heating pipes of a tubular rotary dryer which is provided with an annular collecting pipe disposed continuously around the drying drum.

The drums of tubular rotary dryers are inclined from the horizontal and often have a diameter of 3 to 4 meters and a length up to 30 meters and more. Material within the drum is heated by steam-charged heating pipes located within the drum and lying parallel to the longitudinal axis of the drum. Upon rotation of the drum, the material that is to be dried falls between the spaced apart heating pipes. It is necessary to vent air from the interior of these pipes, because undesired air impedes heat transfer and promotes corrosion. Such venting of the heating pipes has been achieved by connecting the outlets of the heating pipes to an annular collecting pipe, disposed continuously around the drum of the dryer. The collecting pipe is vented to the atmosphere by fine regulating valves. This known venting system enables some steam to flow continuously into the atmosphere to maintain the heating pipes free of air.

It has been known to use an annular collecting pipe which is disposed continuously around the dryer drum and is welded rigidly to the jacket of the dryer drum by holding blocks. The collecting pipe is connected by connector pipes to the heating pipes which are subject to longitudinal expansion of 60 to 100 millimeters. Such connector pipes are flexible, helical metal conduit made of rigid materials such as copper, annealed copper or steel. Upon rotation of the drum, the screw couplings of the flexible connector pipes are put under great stress, and fatigue breakdowns occur. In instances when rigid connector pipes are used, thermal expansion of the heating pipes subjects the points of attachment of the rigid pipe to substantial stresses, causing frequent and troublesome fatigue breakdowns.

It has furthermore been known to remove air from the heating pipes and return it to the steam chamber by way of capillary lines disposed helically and lying in the heating pipes. Since the heating pipes are 20 to 30 meters long, one must use a capillary line of just the same length. It is difficult to attach the latter, it knocks against the inside wall of the heating pipe, and on occasion it breaks and grinds through the heating pipe.

The object of the invention is to provide a venting system for rotary tubular dryers, which permits the heating pipes to be vented at any temperature and which avoids fatigue and stress-produced failures of the apparatus.

This object is realized by a venting system wherein the collecting pipe is supported on holding blocks which are movable in a direction parallel to the longitudinal axis of the dryer drum. The collecting pipe is connected by connector pipes to the outlets of the heating pipes.

At least three and preferably five holding blocks are arranged on the collecting pipe, circumferentially spaced at equal intervals from one another. The holding blocks can consist of two metal sheets connected together by spacers, and recessed to form a saddle corresponding to the diameter of the collecting pipe. Rollers are supported by roller mounts located between the metal sheets. The roller mounts are pivoted to permit movement of the rollers longitudinally and radially of the dryer drum. The case of thermally-produced changes of dimensions of the entire system, i.e. a change in the diameter of the collecting pipe tending to move the holding blocks away from the jacket of the dryer drum, the rollers of the holding blocks are maintained in a close contact with the outside wall of the dryer drum. A possible circumferential shifting movement will thus be avoided. In the operating state of the tubular rotary dryer, the outermost position of the roller mount of the holding blocks can be arrested by stop means such as setscrews. In the event of cooling of the collecting pipe, it deforms in a hardly noticeable manner into a polygon, the corners of which are located at the holding blocks.

In a preferred embodiment of the invention, resilient steel pipes such as Ermeto ® pipes are used for the connector lines between the heating pipes and the collecting pipe. Alternatively, one can use sliding shoes or flanges instead of the rollers. The ability of the holding blocks to move parallel to the longitudinal axis of the dryer drum guarantees that the collecting pipe rocks in the same measure as the longitudinal extension of the heating pipes on the jacket of the dryer drum. This avoids imposition of a mechanical load on the connector lines which lead between the heating pipe and the collecting pipes, thus avoiding fatigue and breakdowns of the type experienced with prior venting systems.

The venting system of the invention will be explained in more detail on the basis of the attached drawing.

Figure 1:
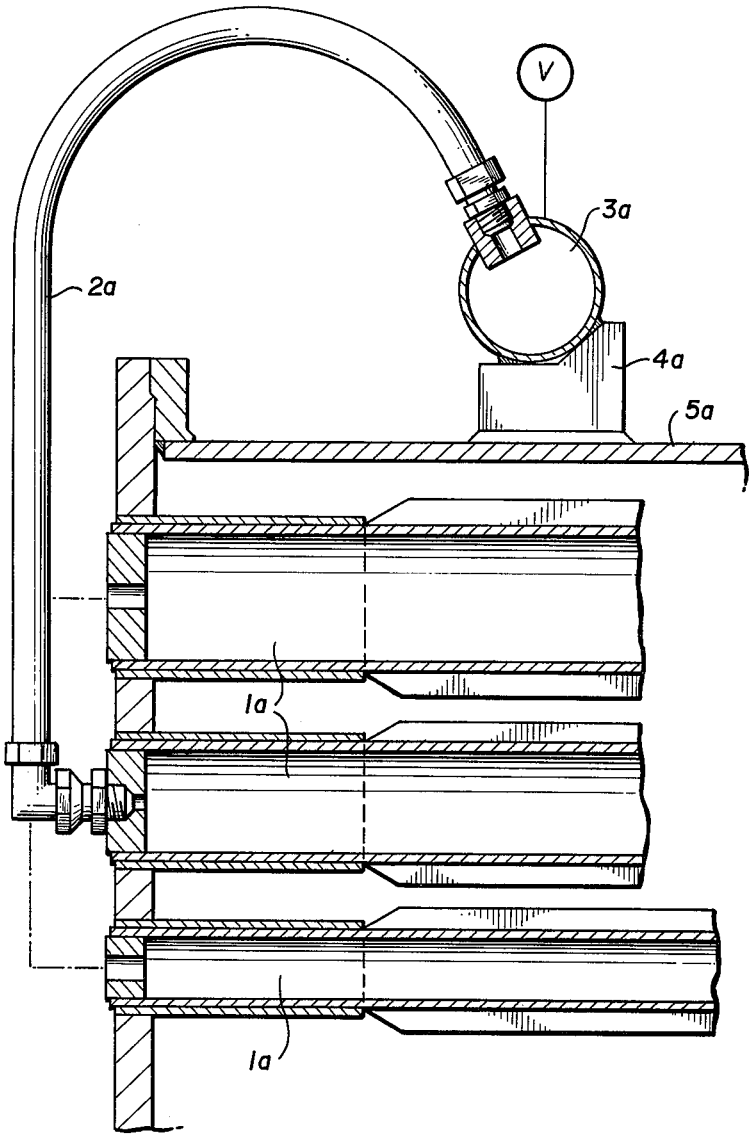
FIG.1 PRIOR ART
FIG. 1 shows a schematic sectional view of a prior art venting system.

According to FIG. 1, a prior art venting system has a steam-charged heating pipe 1*a* connected with the collecting pipe 3*a* by way of a rigid connector pipe 2*a*. The collecting pipe 3*a* is welded firmly to the holding block 4*a* which is welded firmly to the jacket of the dryer drum 5*a*. When heating up the entire tubular rotary dryer, the heating pipes 1*a* expand in their longitudinal direction, while the collecting pipe 3*a* remains firmly anchored on the jacket of the dryer drum and thus the connector pipe 2*a* is exposed to a very great mechanical strain.

Figure 2:
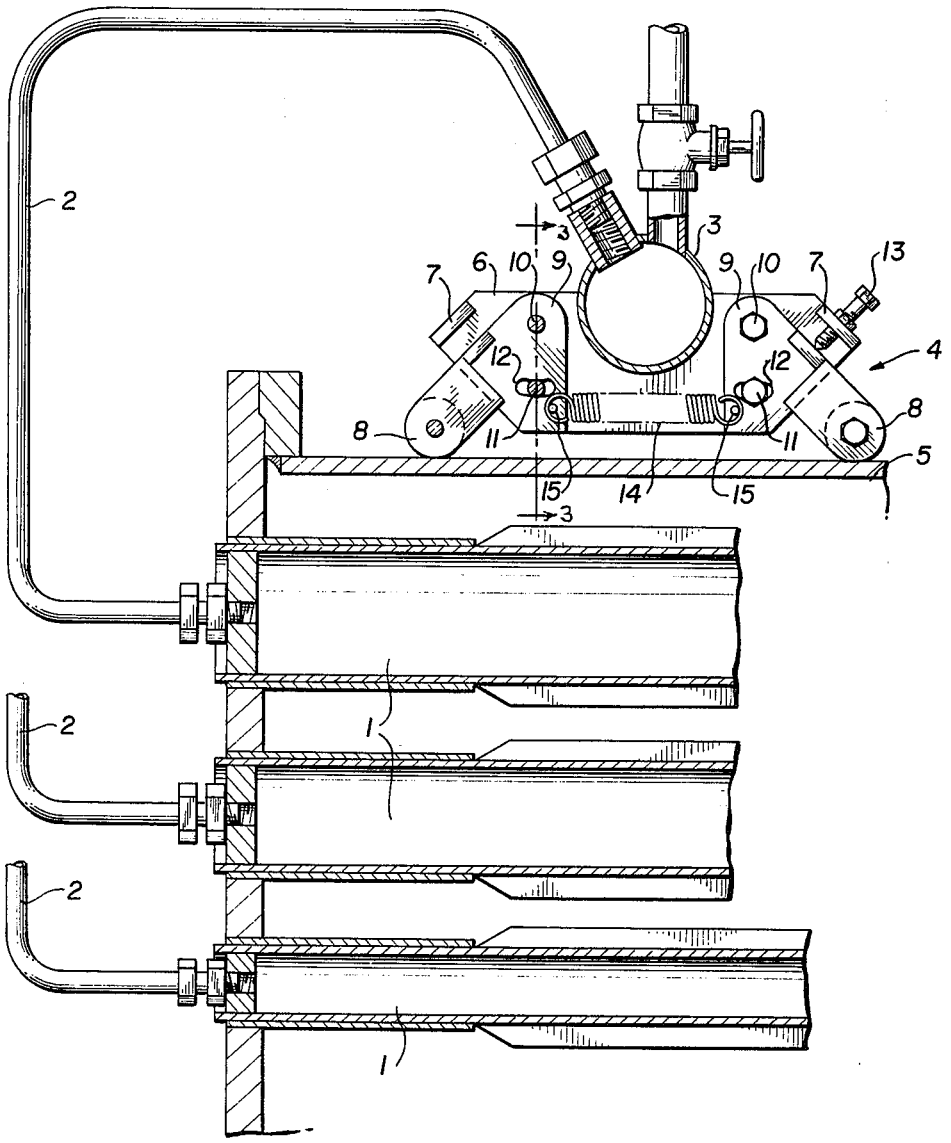
FIG. 2 shows a schematic sectional view cut longitudinally through a venting system according to the invention.
Figure 3:
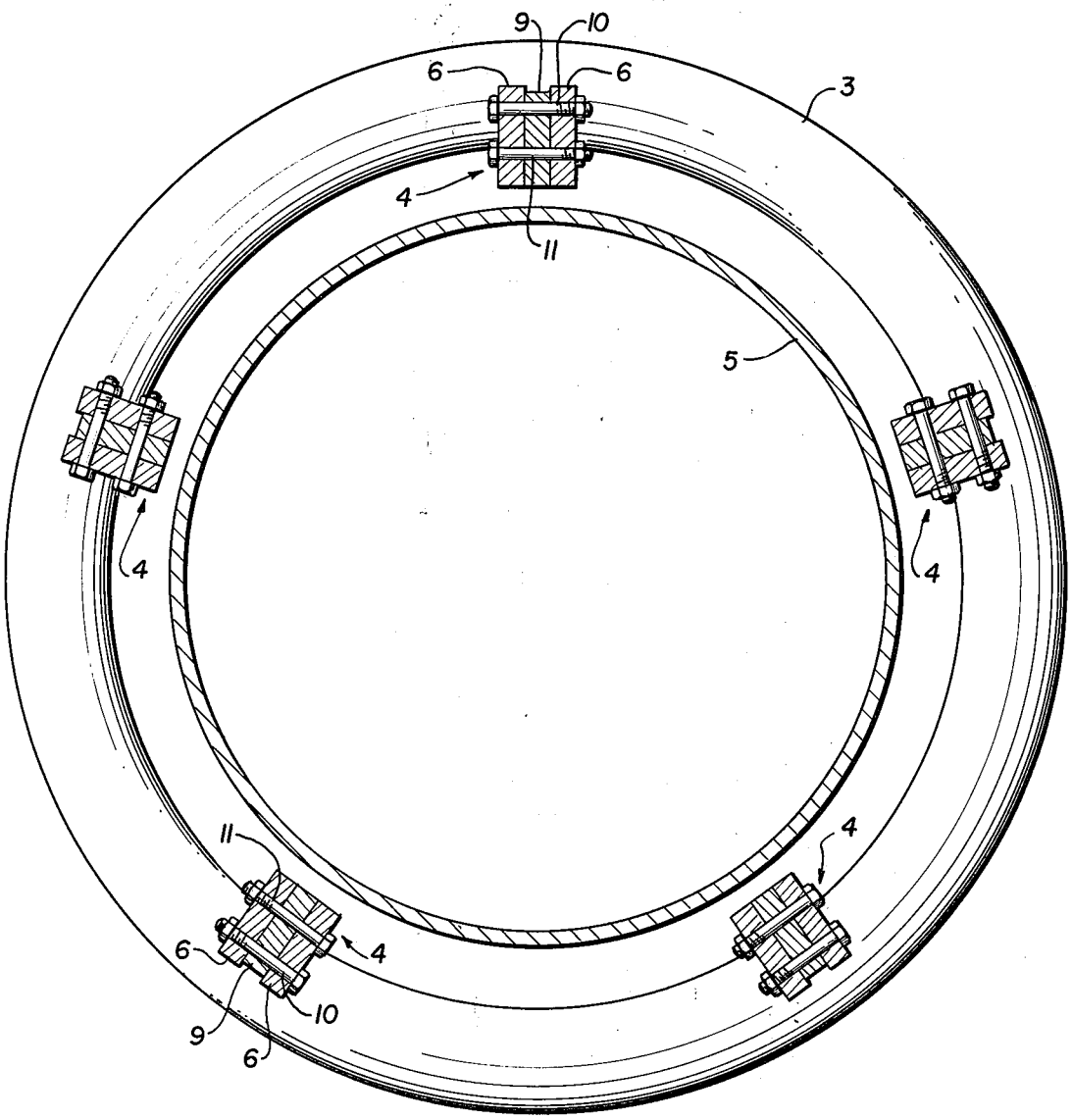
FIG. 3 is a sectional view as seen along the line 3—3 in FIG. 2, omitting the heating pipes for purposes of clarity.

FIGS. 2 and 3 disclose the preferred embodiment of the invention, wherein the heating pipes 1 are connected rigidly with the collecting pipe 3 by connector pipes 2 made of elastic Ermeto ® steel. The collecting pipe 3 is attached to the holding block 4. The holding block 4 is formed of two spaced apart metal plates 6 having their edges recessed to conform to the diameter of the collecting pipe 3. The plates 6 are connected to one another by spacers 7. The holding block 4 is movable on rollers 8 which ride on the outside wall of the dryer drum 5. The roller is mounted on the roller block 4 by roller mount 9 which swings about pivot point 10 and is guided in the oval guide gap 12 by means of a guide peg 11. The outward movement of the roller mount 9 is limited by a setscrew 13. In case of changes of dimensions of the entire venting system as a result of changes in temperature, the outermost position of the roller mount 9 can be adjusted by turning the setscrew 13. A tension spring 14 is attached to the roller mounts 9 at the points 15, and biases the two rollers 8 against the outside wall of the dryer drum. In the event that temperature fluctuations expand the distance between the collecting pipe 3 and the outside wall of the dryer drum, the tension spring 14 will move the roller mounts 9 toward each other and against the drum. In case of a reduction of the distance between the collecting pipe 3 and the outside wall of the dryer drum 5, the roller mounts 9 will move until they contact the stop formed by the setscrew 13.

From the foregoing, it will be appreciated that the venting system according to this invention is superior to the previously-described prior art venting systems, inasmuch as it is able to compensate for dimensional changes resulting from thermal expansion and contraction of elements in the dryer and venting system without introducing into the system any elements which are vulnerable to failure due to rotation of the drum. Those skilled in the art will realize that these results may be achieved by various systems utilizing the concepts of the invention but not conforming precisely to the preferred embodiment disclosed hereinabove. Therefore, it is emphasized that the invention is not limited only to the illustrated preferred embodiment, but encompasses improvements, modifications and variations thereof which lie within the spirit of the following claims.

We claim:

1. A venting system for venting air to a collecting pipe from the heating pipes of a tubular rotary dryer, a dryer drum having a longitudinal axis and being rotatable about said longitudinal axis, heating pipes within said dryer drum, said collecting pipe being disposed annularly and continuously around the dryer drum, holding blocks supporting the collecting pipe on the dryer drum, said holding blocks mounted for movement relative to the drum in a direction parallel to said longitudinal axis of the dryer drum, and connector pipe means for connecting said collecting pipe to the heating pipes.

2. The venting system of claim 1, characterized in that the collecting pipe is disposed on at least three said holding blocks.

3. The venting system of claim 2 having five said holding blocks.

4. The venting system of claim 1 wherein the holding blocks are disposed at equal distances from one another on the collecting pipe.

5. The venting system of claim 1 wherein each of the holding blocks comprises two spaced apart metal plates having edges recessed to correspond to the diameter of the collecting pipe.

6. The venting system of claim 1 wherein the connector pipe means are elastic steel pipes.

7. The venting system of claim 1 having rollers supporting the holding blocks for movement parallel to said longitudinal axis.

8. The venting system of claim 7 wherein each of said holding blocks includes two metal plates, roller mounts for supporting said rollers on said holding blocks, said roller mounts being disposed between the two metal plates of the holding blocks.

9. The venting system of claim 8 wherein said roller mounts are pivotally mounted on the holding blocks.

10. The venting system of claim 7 having resilient means for moving the rollers inwardly into contact with the outside wall of the dryer drum to compensate for thermally-produced dimensional changes.

11. The venting system of claim 10 having means for limiting the outward movement of the rollers.

12. The venting system of claim 11 wherein the connector pipe means are elastic steel pipes.

* * * * *